United States Patent [19]

Hinzmann et al.

[11] Patent Number: 4,886,077

[45] Date of Patent: Dec. 12, 1989

[54] METHOD AND APPARATUS FOR ASSEMBLING PLAIN CIGARETTES WITH FILTER ROD SECTIONS

[75] Inventors: Alfred Hinzmann, Weams; Peter M. Preisner, Mechanicsville; Timour T. Shu, Chesterfield, all of Va.

[73] Assignee: Körber AG, Hamburg, Fed. Rep. of Germany

[21] Appl. No.: 557,662

[22] Filed: Dec. 2, 1983

Related U.S. Application Data

[63] Continuation-in-part of Ser. No. 531,918, Sep. 13, 1983, Pat. No. 4,564,029.

[51] Int. Cl.[4] ..... A24C 5/00; A24C 5/32; A24C 5/35; A24C 5/47

[52] U.S. Cl. ..... 131/282; 131/94

[58] Field of Search ..... 131/84 B, 108, 282, 131/283, 94

[56] References Cited

U.S. PATENT DOCUMENTS

Re. 26,900 5/1970 Bohn et al. ..... 131/9 X 3,081,778 3/1963 Dearsley ..... 131/94

4,055,192 10/1977 Berlin et al. ..... 131/84 B

*Primary Examiner*—J. Millin

*Attorney, Agent, or Firm*—Peter K. Kontler

[57] ABSTRACT

Plain cigarettes of unit length are fed into successive axially parallel peripheral flutes of a rotary drum-shaped first conveyor in such a way that each cigarette enters a first end portion of the respective flute. The second end portions of the flutes have suction ports which attract the cigarettes in alternate flutes so that such cigarettes move axially and provide room for introduction of additional cigarettes whereby each second flute contains a pair of coaxial cigarettes which define a gap for a filter rod section of double unit length. Pairs of coaxial cigarettes in alternate flutes are released for transfer into the axially parallel peripheral flutes of a second drum-shaped conveyor by a system of valving elements composed of a stationary valving element in the interior of the first conveyor and a rotary valving element which connects at intervals two axially parallel bores of the stationary valving element with a suction generating device.

21 Claims, 5 Drawing Sheets

METHOD AND APPARATUS FOR ASSEMBLING PLAIN CIGARETTES WITH FILTER ROD SECTIONS

CROSS-REFERENCE TO RELATED CASE

This is a continuation-in-part of our copending patent application Ser. No. 531,918 filed Sept. 13, 1983 for "Method and apparatus for assembling plain cigarettes with filter rod sections", now U.S. Pat. No. 4,564,029 granted Jan. 14, 1986.

BACKGROUND OF THE INVENTION

The present invention relates to a method of and to an apparatus for assembling rod-shaped articles of the tobacco processing industry. More particularly, the invention relates to a method and apparatus for assembling tobacco-containing rod-shaped articles and filter rod sections into groups which are ready for conversion into filter cigarettes, cigars or cigarillos of unit length or multiple unit length. For the sake of simplicity, the tobacco-containing articles will be referred to as plain cigarettes and the filter rod sections will be referred to as filter plugs of double unit length. However, it is to be understood that the novel method and apparatus can be resorted to with equal advantage for the assembly of groups which can be converted into filter tipped smokers' products other than filter cigarettes.

The making of limited or short series of filter cigarettes is often desirable and necessary for use in laboratories, e.g., to test different brands of tobacco. The customary high-speed filter tipping machines are not ideally suited for such purposes because their output is very high and their use for purposes other than mass production of commercially salable filter cigarettes is unwarranted in view of the very high losses which result from conversion of such machines for the making of short series of filter cigarettes which are to be tested in laboratories for appearance, quality, smell and/or other characteristics.

Many presently popular high-speed filter tipping machines are designed to advance a succession of plain cigarettes of double unit length sideways (i.e., at right angles to the axes of the cigarettes), to sever successive cigarettes midway between their ends so that each such cigarette yields two plain cigarettes of unit length, to move the thus obtained pairs of plain cigarettes of unit length axially and away from one another so as to provide room for insertion of a filter plug of double unit length, to insert the plugs of double unit length between successive pairs of coaxial plain cigarettes of unit length, to drape uniting bands around the filter plus of double unit length and the adjoining end portions of plain cigarettes of unit length so as to convert each such group of rod shaped articles into a filter cigarette of double unit length, and to convert successive filter cigarettes of double unit length into filter cigarettes of unit length by severing the filter cigarettes of double unit length midway between their ends, i.e., across the convoluted uniting bands and the filter plugs of double unit length.

In accordance with another prior proposal which is disclosed in U.S. Pat. No. 2,649,761, filter cigarettes of double unit length are formed by placing two discrete magazines next to a drum-shaped conveyor storing in each magazine a supply of plain cigarettes of unit length. The two magazines supply plain cigarettes of unit length into spaced-apart portions of successive flutes of the conveyor so that the gaps between the pairs of coaxial plain cigarettes of unit length are sufficiently wide to allow for insertion of filter plugs of double unit length. The machine which is disclosed in this patent is designed for mass production of filter cigarettes. It has been found that such machine is rather expensive, primarily or to a large extent because it must be equipped with pairs of discrete magazines for plain cigarettes of unit length which entails the provision of pairs of devices which deliver plain cigarettes of unit length to such magazines. Moreover, the magazines take up a substantial amount of space, especially if they are to store relatively large quantities of plain cigarettes of unit length so that the machine can remain in operation for a reasonably long interval of time even if the supply of fresh plain cigarettes to the magazines is interrupted. Such machine is not suited for the production of relatively short series of filter cigarettes because its space requirements, cost and weight are excessive.

OBJECTS AND SUMMARY OF THE INVENTION

An object of the invention is to provide a novel and improved method of manipulating rod-shaped tobacco-containing articles and filter rod sections preparatory to assembly of such commodities into filter cigarettes or the like.

Another object of the invention is to provide a method which is especially suited for the treatment of rod-shaped commodities prior to their conversion into short series of filter cigarettes or the like such as are required for testing in laboratories in order to ascertain the characteristics of various blends of tobacco.

A further object of the invention is to provide a method of the above outlined character which can be resorted to for economical production of short series of filter cigarettes or the like.

An additional object of the invention is to provide a novel and improved apparatus for the practice of the above outlined method and to construct and assemble the apparatus in such a way that it occupies little room, that its initial and maintenance cost are low, that it can be rapidly converted for the making of different types of filter cigarettes or the like, and that it can turn out filter tipped smokers' products whose quality at least approaches that of products which are turned out by commercially available mass-producing filter tipping and analogous machines.

Another object of the invention is to provide an apparatus wherein a single magazine suffices to supply the tobacco-containing rod-shaped articles, wherein such articles are manipulated in a novel and improved way prior to assembly with filter rod sections, and which is much simpler, less expensive and less sensitive than commercially available mass-producing filter tipping machines.

A further object of the invention is to provide the apparatus with novel and improved means for shifting selected rod-shaped articles axially preparatory to assembly of such articles with filter rod sections.

Another object of the invention is to provide filter tipping machine whose bulk, weight and cost are a relatively small fraction of the bulk, weight and cost of commercially used filter tipping machines.

An additional object of the invention is to provide a novel and improved article manipulating conveyor for use in an apparatus of the above outlined character.

A further object of the invention is to provide the conveyor with novel and improved means for selectively retaining and releasing rod-shaped articles.

Another object of the invention is to provide a conveyor which can be used in conventional filter tipping and analogous machines for the manipulation of rod-shaped articles prior to their transfer onto a next-following conveyor.

Still another object of the invention is to provide a conveyor which can convert a single row of rod-shaped articles into sets of coaxial articles and which can deliver such sets into successive receiving means of a next-following conveyor.

An additional object of the invention is to provide a drum-shaped conveyor which can automatically shift rod-shaped articles axially from first to second positions and which can deliver alternating shifted articles to a further conveyor.

One feature of the invention resides in the provision of a method of assembling plain cigarettes or analogous rod-shaped tobacco-containing articles with filter rod sections on an endless conveyor preparatory to conversion of assembled articles and sections into filter cigarettes or like rod-shaped smokers' products, particularly of making limited series of such products for use in laboratories rather than for sale to the general public. The method comprises the steps of delivering successive articles to the endless conveyor so that the articles occupy first positions, advancing the delivered articles with the conveyor at right angles to the axes of such articles, shifting the articles axially to second positions which are spaced apart from the respective first positions by distances at least matching the length of a filter rod section so that the shifted articles provide room for delivery of fresh articles to the first positions previously occupied by the shifted articles and each shifted article is in axial register with a non-shifted article, and introducing filter rod sections between the thus obtained pairs of registering articles or vice versa.

The shifting step can be performed by resort to pneumatic shifting means and includes moving the respective articles axially through distances at least approximating the combined length of an article and a filter rod section. Each article can constitute a plain cigarette of unit length, and each filter rod section can constitute a filter plug of double unit length.

The delivering step can comprise establishing and maintaining a single supply of parallel articles and feeding the articles from the supply (e.g., by gravity flow), at right angles to the axes of the articles and onto the endless conveyor. The conveyor may be of the type having a series of parallel receiving means for rod-shaped articles and defining an endless path for the receiving means. The delivering step then comprises admitting successive articles into successive receiving means of the series, and such method can further comprise the step of holding each shifted article in the respective receiving means for an interval which is longer than necessary for a single transport along the endless path so that each shifted article registers with an article which is subsequently delivered to the same receiving means and occupies the first position therein. Such method can further comprise the step of transferring successive pairs of registering articles from the respective receiving means onto a second conveyor (e.g., into the peripheral flutes of a rotary drum), and the introducing step then preferably comprises inserting filter rod sections into the spaces between pairs of registering articles on the second conveyor. Such inserting step can precede the transferring step, i.e., a flute of the second conveyor can receive a filter rod section prior to receiving a pair of registering articles from the first conveyor.

Another feature of the invention resides in the provision of an apparatus for assembling plain cigarettes or analogous rod-shaped tobacco-containing articles with filter rod sections preparatory to conversion of assembled articles and filter rod sections into filter cigarettes or like rod-shaped smokers' products, particularly for the making of limited series of such products. The apparatus comprises a first conveyor having a plurality of parallel receiving means arranged to advance along an endless path, means for delivering discrete articles into successive receiving means so that each of the thus delivered articles assumes a predetermined first position in the respective receiving means, means for shifting articles in the respective receiving means axially from the first positions to predetermined second positions through distances at least matching the combined length of an article and a filter rod section whereby the thus shifted articles provide room for delivery of fresh articles with attendant accumulation of pairs of coaxial articles in the respective receiving means, a second conveyor which serves to receive pairs of coaxial articles from the receiving means of the first conveyor, and means for introducing filter rod sections into the spaces between pairs of articles on one of the two conveyors. The delivering means preferably comprises means for advancing the articles at right angles to the axes of the respective articles.

The second conveyor preferably also comprises a plurality of parallel receiving means for pairs of articles, and the receiving means of the second conveyor are arranged to advance along a second endless path in a direction at right angles to the axes of the articles therein. The receiving means of the second conveyor can receive pairs of articles from alternate receiving means of the first conveyor.

The introducing means preferably comprises a third conveyor which serves to insert filter rod sections into the receiving means of the second conveyor, either ahead or downstream of the locus where the receiving means of the second conveyor receive pairs of coaxial articles.

The delivering means can comprise a magazine which serves to store a supply of parallel articles and has outlet means defining a channel which discharges at least one layer of parallel articles in a direction at right angles to the axes of the respective articles. The magazine can be disposed at a level above the first conveyor so that the channel can deliver to the first conveyor a succession of rod-shaped articles by gravity flow.

The receiving means of the first conveyor can constitute elongated flutes each having a length at least matching the combined length of two articles and a filter rod section. The arrangement is preferably such that each article which assumes the first position is adjacent to one end of the respective flute and each article which assumes the second position is adjacent to the other end of the respective flute. The number of flutes is preferably $n_1$ ($n_1$ is a whole odd number in excess of one) and the second conveyor then preferably comprises $$n_2 = \frac{n_1 \pm 1}{2}$$

receiving means, preferably in the form of elongated flutes machined into the peripheral surface of a drum-shaped rotary second conveyor. This ensures that alternate flutes of the first conveyor deliver pairs of coaxial rod-shaped articles to successive flutes of the second conveyor. Generally, the mutual spacing of neighboring flutes on the first conveyor can equal half the mutual spacing of flutes on the second conveyor. Other ratios are possible by changing the diameter of the second conveyor and/or by changing the speed of the second conveyor with reference to the first conveyor and/or vice versa.

The shifting means preferably comprises means for pneumatically moving the articles from first to second positions. To this end, the receiving means of the first conveyor preferably comprises elongated flutes having open sides facing away from the axis of the first conveyor, and the moving means can comprise a shroud which is outwardly adjacent to a predetermined portion of the endless path for the flutes of the first conveyor and serves to at least substantially seal the open sides of the flutes in such portion of the endless path, a disc or other suitable means for at least substantially sealing one end of each flute in the predetermined portion of the path, and at least one suction port provided in each flute in the region of the one end to draw air by way of the other end whereby the inflowing stream of air shifts an article from the first to the second position. The afore-discussed portion of the endless path for the flutes of the first conveyor can be disposed immediately downstream of the delivering means, as considered in the direction of advancement of flutes along the endless path.

A further feature of the invention resides in the provision of a conveyor for transport and manipulation of rod-shaped articles, particularly rod-shaped articles which constitute or form part of smokers' products. The conveyor comprises a plurality of parallel and preferably equidistant article receiving means arranged to advance along an endless path and to receive articles in at least one first portion of such path, at least one suction port provided in each receiving means, a suction generating device, and valving means which is operative to connect the suction generating device only with the suction ports of alternate receiving means during travel of such alternate receiving means in a predetermined second portion of the endless path. The conveyor preferably comprises a substantially drum-shaped body having a peripheral surface provided with axially parallel flutes which constitute the receiving means. The valving means preferably comprises a stationary valving element and a mobile valving element which is preferably coaxial with the body and is interposed between the suction generating device and the stationary valving element. The suction generating device is preferably stationary, and the aforementioned path is preferably an endless circular path. The drum-shaped body is preferably hollow to receive at least a portion of the stationary valving element which is formed with at least one passage communicating with the suction ports of successive receiving means in the second portion of the path. The rotary valving element is then arranged to connect the passage with the suction generating device during travel of alternate receiving means in the second portion of the path. To this end, the rotary valving element is preferably provided with a plurality of preferably equidistant channels which form an annulus and each of which is arranged to connect the suction generating device with the passage of the stationary valving element in a different angular position of the rotary valving element. The number of channels preferably equals $$\frac{n_1 \pm 1}{2}$$

wherein $n_1$ is an odd number exceeding one and denoting the number of receiving means. Such conveyor further comprises means for rotating the body and the rotary valving element at different speeds so that successive channels of the rotary valving element communicate with and connect the suction generating device with the passage when the suction ports of alternate receiving means communicate with the passage.

The ratio of speeds of the rotary valving element and the drum shaped body is proportional to the ratio of angular distance between neighboring channels of the rotary valving element to angular distance between alternate receiving means. The drum-shaped body can constitute a hollow cylinder having radial bores which constitute the suction ports, and the stationary valving element preferably constitutes a bearing for and is partially surrounded by the hollow cylinder. The rotary valving element is preferably in sliding and sealing contact with an end face of the stationary valving element which is preferably provided with first and second passages extending from such end face and communicating with successive suction ports when the hollow cylinder rotates. One of these passages communicates with the suction ports of flutes which are then located in the second portion of the endless path. Each channel of the rotary valving element communicates seriatim with the first and second passages of the stationary valving element and the conveyor preferably further comprises first and second stationary shoes which are in sliding contact with the rotary valving element and respectively serve to connect the suction generating device with the channels which communicate with the first and second passages of the stationary valving element. The means for rotating the drum-shaped body and the rotary valving element at different speeds can comprise a prime mover (e.g., a variable speed electric motor which drives all or nearly all mobile components of a filter tipping machine) and a transmission which receives torque from the main prime mover. The transmission drives the rotary valving element and the prime mover drives the drum-shaped body or vice versa. The transmission can constitute a gear train and the first speed exceeds the second speed or vice versa, depending on the ratio of the number of receiving means to the number of channels.

If the conveyor is designed for the transport of plain cigarettes of unit length which are to be assembled with filter rod sections or filter plugs of double unit length, the length of each receiving means preferably at least matches the combined length of two plain cigarettes of unit length plus the length of a single filter rod section of double unit length. This renders it possible to admit into each receiving means two coaxial plain cigarettes and to provide between the coaxial cigarettes a gap whose width matches or exceeds the length of a filter rod section of double unit length.

Each receiving means can be provided with at least one additional suction port which can be used to shift rod-shaped articles longitudinally of the respective receiving means, and the valving means is then designed to connect the suction generating device with the additional suction ports of successive receiving means in a portion of the endless path other than the second portion. The connection can be established, for example, by way of the other passage in the stationary valving element.

Still further, the conveyor preferably comprises means for mechanically retaining rod-shaped articles in the respective receiving means during travel of the receiving means in at least one predetermined portion of the endless path. For example, such retaining means can comprise one or more arcuate rails, rods, bars or shrouds which are adjacent to the endless path.

The novel features which are considered as characteristic of the invention are set forth in particular in the appended claims. The improved apparatus and conveyor themselves, however, both as to their construction and their mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
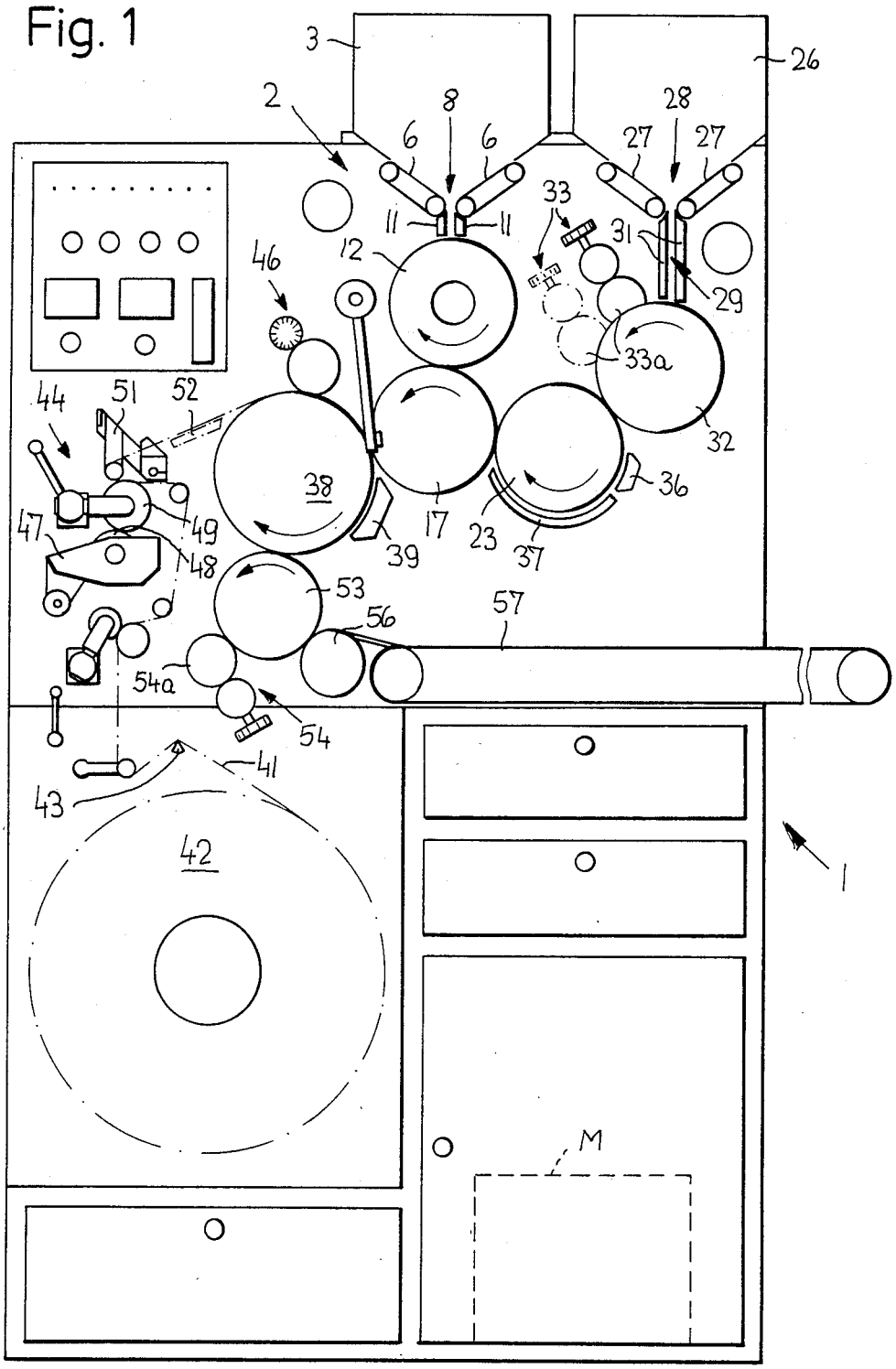
FIG. 1 is a somewhat schematic front elevational view of a filter tipping machine embodying an apparatus which is constructed and assembled in accordance with the invention.

Referring to FIG. 1, there is shown a filter tipping machine which can be used for the production of short series of filter cigarettes, e.g., for the production of short series which are to be tested in a laboratory. The machine comprises a frame 1 the upper part of which carries an apparatus 2 which embodies the invention and is designed to assemble pairs of plain cigarettes 4' and 4" (see FIGS. 2, 2*a* and 3) of unit length with discrete filter rod sections 24 of double unit length preparatory to conversion of the thus obtained groups G (FIG. 2*a*) into filter cigarettes of double unit length. The apparatus 2 is shown in greater detail in FIGS. 2 and 2*a* and comprises a first rotary drum-shaped conveyor 12, a second rotary drum-shaped conveyor 17, a third rotary conveyor 23, a device which delivers plain cigarettes 4 of unit length into successive axially parallel peripheral article receiving means or flutes 13 of the conveyor 12, and a device for shifting certain plain cigarettes 4 in the flutes 13 of the conveyor 12. The means for delivering plain cigarettes 4 of unit length to the flutes 13 comprises a magazine 3 which stores a supply of parallel cigarettes 4 and the lower portion of which includes two endless belt conveyors 6 which are driven to advance in the directions indicated by arrows 7. The outlet 8 of the magazine 3 comprises a channel 9 between two parallel vertical walls 11 which allow a single row of parallel cigarettes 4 to descend by gravity into the right-hand end portions of successive flutes 13. The conveyors 6 ensure that the channel 9 is continuously filled with a single layer of parallel cigarettes 4. The width of the channel 9 between the walls 11 slightly exceeds the diameter of a cigarette 4 to thus reduce the likelihood of jamming. The cigarettes 4 in the magazine 3 and in the channel 9 of its outlet 8 are parallel to each other and are caused to advance sideways, namely, at right angles to their respective axes. The cigarettes 4 in the magazine 3 are parallel to the cigarettes 4' and 4" in the flutes 13 of the first conveyor 12. Such flutes are caused to advance along an endless path about the horizontal axis of the conveyor 12. The number ($n_1$) of flutes 13 is an odd number exceeding one. For example, the conveyor 12 can be provided with twenty three equidistant flutes 13.

The length of each flute 13 at least matches the combined length of two cigarettes 4 of unit length and a single filter rod section 24 of double unit length. The position of the channel 9 with reference to the conveyor 12 is such that the channel 9 admits plain cigarettes 4 into the right-hand end portions of successive flutes 13, as viewed in FIG. 2 wherein the thus delivered cigarettes 4 assume first positions indicated at 14. As the conveyor 12 rotates in a clockwise direction (reference being had to FIGS. 1 and 2), successive flutes 13 receive discrete cigarettes 4 and advance such cigarettes along the inner side of an arcuate shroud 16 which extends along an arc of nearly 180 degrees toward the transfer station between the conveyors 12 and 17. The shroud 16 overlies the open sides 13*f* flutes 13, namely, those sides which face away from the axis of the conveyor 12, and serves to at least substantially seal such outer sides from the surrounding atmosphere. The right-hand ends of all flutes 13 are open, and the left-hand ends of such flutes are at least substantially sealed by a stationary or rotary disc-shaped sealing member 18 which can be secured to the respective end portion of the shroud 16. The left-hand end portion of each flute 13 is formed with one or more suction ports 19 which draw air from the surrounding atmosphere by way of the open right-hand ends of the respective flutes 13, as viewed in FIG. 2, whereby the streams of air shift the cigarettes 4 from the first positions 14 to second positions 21 which are adjacent to the disc-shaped sealing member 18. The suction ports 19 are effective only when the left-hand portions of the flutes 13 which are inwardly adjacent to the shroud 16 are unoccupied. Once the left-hand portion of a flute 13 already contains a cigarette 4" (in the second position 21), the corresponding suction port 19 is incapable of shifting a freshly delivered cigarette 4 which occupies the first position 14, i.e., the position vacated by the shifted cigarette 4" which then occupies the position 21. The shroud 16, the disc-shaped sealing member 18 and the suction ports 19 can be said to constitute a means for shifting successive cigarettes 4 axially from the positions 14 to the positions 21 during travel of the respective flutes 13 along a predetermined portion of their endless path, namely, immediately downstream of the channel 9, as considered in the direction of rotation of the first conveyor 12. The depth of each flute 13 at least equals the diameter of a cigarette 4 to thus ensure that the cigarettes can readily advance beneath the shroud 16 on their way toward the transfer station between the conveyors 12 and 17. One mode in which the suction ports 19 are connected to a suction generating device during those stages of rotation of the conveyor 12 when the cigarettes 4 are supposed to move from the positions 14 to the positions 21 is illustrated in FIG. 3. The distance between a cigarette 4' in the first position 14 and a cigarette 4'' in the second position 21 (in one and the same flute 13) preferably equals the length of a filter rod section 24 of double unit length. This ensures that the cigarettes 4' and 4'' which form a pair of coaxial rod-shaped articles in a given flute 13 or in a flute 22 of the second conveyor 17 need not be shifted axially toward each other in order to abut against the respective ends of a filter rod section 24 therebetween.

The number of axially parallel peripheral flutes 22 of the second conveyor 17 is selected in such a way that successive flutes 22 receive pairs of spaced-part coaxial cigarettes 4 from alternate flutes 13 of the conveyor 12. This can be achieved if the number $n_2$) of flutes 22 equals $$n_2 = \frac{n_1 \pm 1}{2}$$

wherein $n_1$ is the number of flutes 13. If the conveyor is formed with twenty three flutes 13, the number of flutes 22 is twelve or eleven.

The conveyor 23 can be provided with axially parallel peripheral flutes **23*a* whose number matches the number of flutes 22 and each of which serves to deliver a discrete filter rod section 24 of double unit length to the transfer station between the conveyors 17 and 23. Such transfer station is located ahead of the transfer station between the conveyors 12 and 17, as considered in the direction of rotation of the conveyor 17. This means that each flute 22 receives a discrete filter rod section 24 (at the transfer station between the conveyors 17 and 23) before it receives a pair of coaxial cigarettes 4' and 4'' from the conveyor 12. The flutes 22 and 23*a* are or can be provided with suction ports to attract the rod-shaped articles therein during predetermined stages of each revolution of the respective conveyors. If desired, such suction ports can be used in addition to or they can be replaced by mechanical retaining means which prevent the articles 4', 4'' and 24** from escaping under the action of gravity and/or centrifugal force.

Figure 2:
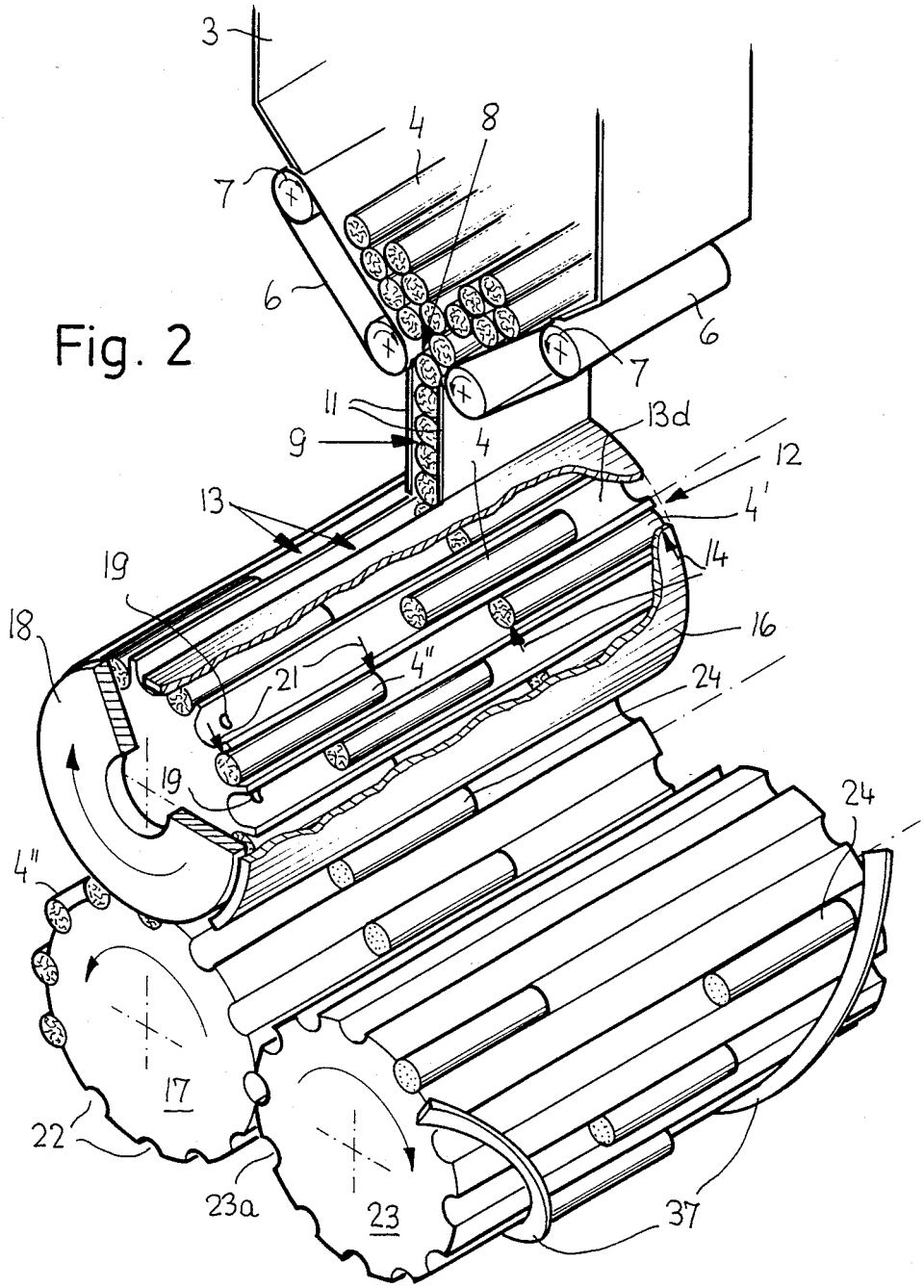
FIG. 2 is an enlarged perspective view of the apparatus, with certain parts broken away.
Figure 2A:
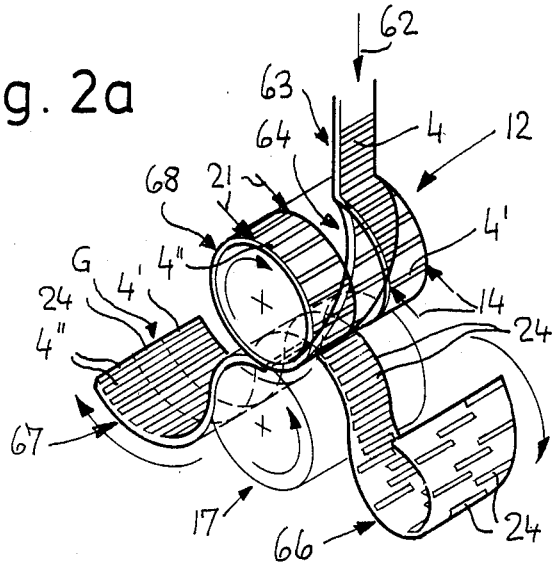
FIG. 2*a* is a smaller-scale perspective view of the apparatus, showing the paths of rod-shaped articles, of filter rod sections and of groups consisting of pairs of rod-shaped articles and filter rod sections.
Figure 3:
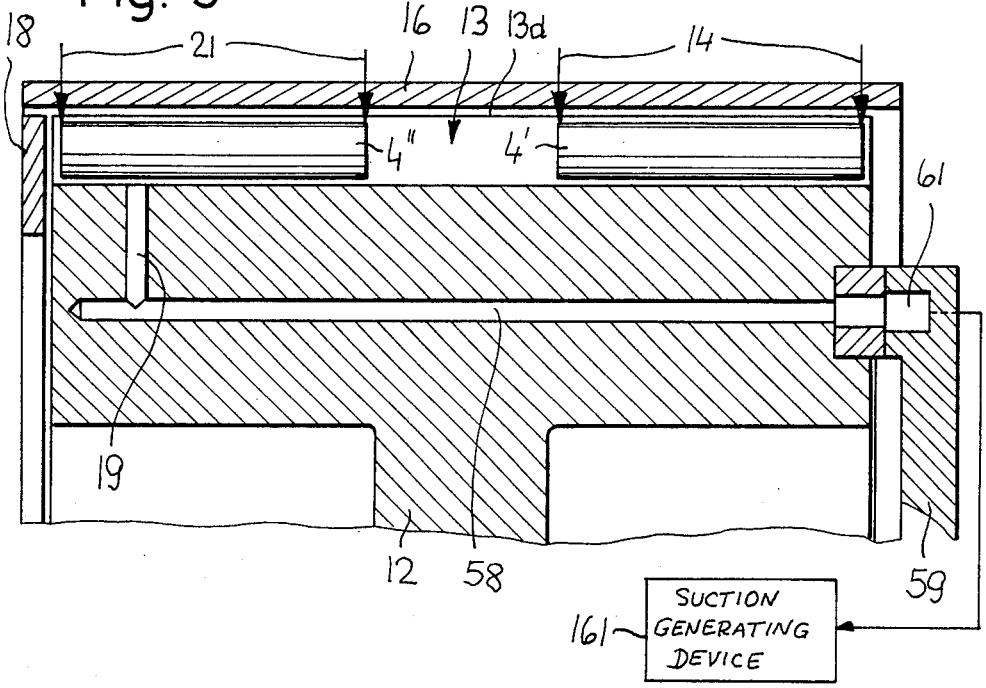
FIG. 3 is a fragmentary axial sectional view of the first conveyor and of the means for shifting rod-shaped articles in the flutes of the first conveyor.

The mode of operation of the assembling apparatus 2 is as follows:

The channel 9 of the magazine 3 delivers (see the arrow 62 in FIG. **2*a*) plain cigarettes 4 of unit length along a vertical path 63 (FIG. 2*a*) into successive flutes 13 of the first conveyor 12 in such a way that the thus delivered cigarettes 4 occupy first positions 14 at the right-hand ends of the respective flutes 13, as viewed in FIG. 2 or 2*a*. Each second flute 13 is empty (i.e., its left-hand portion does not contain a cigarette 4'' in the position 21) when it advances past the discharge end of the channel 9 so that the cigarette 4 which assumes the position 14 in such otherwise empty flute 13 is free to move axially toward the second position 21 while advancing along an arcuate path 64 (FIG. 2*a*) beneath the shroud 16 from the magazine 3 toward the transfer station between the conveyors 12 and 17. The shifting of such cigarette 4 from the position 14 to the position 21 is completed ahead of the just mentioned transfer station so that the cigarette 4'' in the position 21 is located at a predetermined distance from the open right-hand end of the respective flute 13. The angular positions of the conveyors 12 and 17 relative to each other are selected in such a way that the flute 13 which contains a cigarette 4'' in the second position 21 (i.e., adjacent to the inner side of the disc-shaped sealing member 18) does not register with a flute 22 during travel past the transfer station between the conveyors 12 and 17. In other words, a cigarette 4'' which has been moved to the position 21 continues to remain in the respective flute 13 and completes more than one full revolution about the axis of the conveyor 12. When such flute returns into a position of register with the discharge end of the channel 9 (by moving along an arcuate path 68 shown in FIG. 2*a*), the channel 9 admits a fresh cigarette 4 which assumes the position 14 so that the respective flute 13 then contains two coaxial cigarettes 4' and 4'' which are separated from each other by a gap having a width matching the length of a filter rod section 24 of double unit length. The flute 13 with two coaxial cigarettes 4' and 4'' therein then advances along the path 64 toward the transfer station between the conveyors 12, 17 and comes into register with an oncoming empty flute 22 whose suction ports attract the pair of cigarettes 4' and 4'' so that such pair is transferred onto the conveyor 17. It will be noted that each flute 13 registers with a flute 22 during each second revolution of the conveyor 13 and this explains the fact that each second flute 13 advancing past the discharge end of the channel 9 does not contain any cigarettes 4 whereas the flutes 13 flanking such empty flute each contain a single plain cigarette 4'' in the second position 21. Therefore, each flute 13 which advances past the channel 9 receives therefrom a fresh cigarette 4 but only each second cigarette 4 is thereupon shifted from the first position 14 to the second position 21. The suction ports 19 in the flutes 13 are effective to initiate an axial movement of cigarettes 4 from the first positions 14 to the second positions 21 only when the second positions 21 are still unoccupied; the suction ports 19 in the remaining flutes 13 could serve to attract the respective cigarettes 4'' and hold them in the second positions 21 until such cigarettes reach the transfer station between the conveyors 12, 17 and the respective flutes 13 register with the oncoming flutes 22. In other words, a suction port 19 can attract a cigarette 4 from the first position 14 to the second position 21 only when the second position 21 is still unoccupied, and this results in the accumulation of pairs of properly spaced-apart coaxial cigarettes 4' and 4'' in those flutes 13 which are in the process of moving toward positions of registry with the oncoming flutes 22 of the conveyor 17**.

When a flute 22 receives two coaxial cigarettes 4' and 4'' from a flute 13, it already contains a filter rod section 24 of double unit length (which has been delivered thereto along the arcuate path 66 shown in FIG. **2*a*) so that each flute 22 which advances beyond the transfer station between the conveyors 12 and 17 contains a group G of three coaxial rod-shaped components including two cigarettes 4',4'' and a filter rod section 24** therebetween. Such groups G are thereupon taken over by a transfer conveyor 38 which is shown in FIG. 1 and advance along an arcuate path 67 which is shown in FIG. 2*a*.

An important advantage of the assembling apparatus 2 is its simplicity as well as its compactness. These highly desirable characteristics of an apparatus for use in a filter tipping machine which is to turn out relatively short series of filter cigarettes are attributable to the feature that the magazine 3 need not store two sets of plain cigarettes and to the novel mode of converting a single row of plain cigarettes 4 which issue from the channel 9 into pairs of properly spaced-apart coaxial cigarettes 4' and 4" which provide room for insertion of filter rod sections 24 therebetween.

Filter rod sections 24 of double unit length are obtained by subdividing filter rod sections of six times unit length which are stored in a magazine 26. The magazine 26 is mounted in or on the frame 1 adjacent to the magazine 3 and its lower portion is flanked by two downwardly sloping endless belt conveyors 27 which compel the filter rod sections of six times unit length to advance into an outlet 28 including a channel 29 between two parallel vertical sidewalls 31. Successive filter rod sections of six times unit length enter successive flutes of a rotary drum-shaped severing conveyor 32 which cooperates with two rotary disc-shaped knives 33*a* receiving motion from a suitable drive 33 and being disposed in two different planes so as to convert successive filter rod sections of six times unit length into sets of three coaxial filter rod sections 24 of double unit length. Such sets of coaxial sections 24 are shuffled at 36 in the customary way to form a single row of accurately aligned sections 24 which are admitted into successive flutes 23*a* of the third conveyor 23. The shuffling is assisted by two arcuate guide rails 37 which are adjacent to the periphery of the third conveyor 23 and serve to steer successive sections 24 into the central portions of the oncoming flutes 22 so that the sections 24 in the flutes 22 do not interfere with the transfer of the respective pairs of plain cigarettes 4' and 4" from alternate flutes 13 of the conveyor 12.

The groups G which are assembled in the flutes 22 of the second conveyor 17 are transferred into successive flutes of the rotary drum-shaped transfer conveyor 38, and each group G on the conveyor 38 is provided with an adhesive-coated uniting band which is thereupon convoluted around the respective filter plug 24 and the adjacent end portions of the corresponding cigarettes 4' and 4" to convert each group G into a filter cigarette of double unit length. The convoluting operation is effected by the conveyor 38 jointly with a rolling device 39 which can be of the type disclosed in commonly owned U.S. Pat. Nos. 3,483,873 and 3,527,234 to Hinzmann. Uniting bands are obtained by subdividing a continuous web 41 of tipping paper which is drawn off a reel 42 and is caused to pass over a so-called curling device 43 of the type disclosed in commonly owned U.S. Pat. No. 3,962,957 to Hinzmann. The thus pretreated web 41 thereupon advances through a paster 44 which coats one of its sides with a suitable adhesive, and the leader of the web 41 is thereupon severed by a cutting device 46 of known design to yield a succession of discrete uniting bands each of which has an adhesive-coated side. Successive uniting bands are attached to successive groups G on the conveyor 38, and such uniting bands are thereupon convoluted around selected portions of the respective groups G during travel through the arcuate gap between the conveyor 38 and rolling device 39.

The paster 44 comprises a trough 47 which contains a supply of adhesive paste. A driven roller 48 is partly immersed in the supply of paste and its peripheral surface transfers a film of adhesive to the peripheral surface of a roller-shaped applicator 49 which coats one side of the running web 41. The reference character 51 denotes a tensioning device which can select and vary the tensional stress upon the web 41. Moreover, the device 51 allows for lateral adjustments of the web 41 to ensure that successive uniting bands will be attached to the oncoming groups G in optimum positions so that each uniting band adheres to the corresponding filter plug 24 along the full axial length of the plug as well as to the adjacent end portions of the corresponding plain cigarettes 4' and 4". The adhesive-coated web 41 is preheated by a heating device 52 which is installed between the tensioning device 51 and the severing device 46. Such heating device is particularly desirable if the adhesive paste in the trough 47 is a hotmelt or another heat-activatable adhesive.

The filter cigarettes of double unit length which are obtained as a result of draping of uniting bands around successive groups G of rod-shaped articles are transferred onto a severing drum 53 which cooperates with a rotary disc-shaped knife 54*a* receiving motion from a drive 54 and serving to subdivide each filter cigarette of double unit length into a pair of coaxial filter cigarettes of unit length. The filter cigarettes of unit length are transferred onto the upper reach of an endless takeoff conveyor belt 57 by way of rotary drum-shaped fluted transfer conveyor 56. The conveyor belt 57 is located in, or delivers cigarettes directly into, a laboratory or into a vessel which can be transferred into the laboratory for examination of the filter cigarettes of unit length. If the laboratory is to examine filter cigarettes of double-unit length, the knife 54*a* is moved away from the severing conveyor 53 so that the conveyor 56 receives filter cigarettes of double unit length.

The manner in which sets of three coaxial filter rod sections 24 are formed and shuffled between the outlet 28 of the magazine 26 and the transfer station between the conveyors 17, 23 of the apparatus 2 is or can be the same as disclosed in commonly owned U.S. Pat. No. 3,282,809 to Meinecke. This patent also shows the manner in which the filter rod sections can be held by suction. Alternatively, the filter tipping machine can comprise a discrete staggering and a discrete shuffling conveyor, such as the conveyors 8 and 9 in FIG. 1 of commonly owned U.S. Pat. No. 4,383,435 to Hinzmann. All of the aforementioned patents are incorporated herein by reference.

FIG. 3 is a fragmentary axial sectional view of the first conveyor 12 of the apparatus 2. It will be noted that the disc-shaped sealing member 18 seals the left-hand end portions of the flutes 13, that the right-hand end portions of the flutes 13 are open, and that the open outer sides 13*f* flutes 13 are at least substantially sealed by the inner side of the shroud 16 in the region where the shroud overlies the peripheral surface of the conveyor 12, namely, between the channel 9 and the transfer station between the conveyors 12 and 17.

The suction ports 19 in the left-hand end portions of the flutes 13 communicate with a suction channel 58 which is machined into the body of the drum-shaped conveyor 12 and has an open end at the right-hand end face of this conveyor. The right-hand end face of the conveyor 12 is adjacent to and is in sealing engagement with a stationary valve plate 59 having an arcuate groove or slot 61 in communication with successive channels 58 and in permanent communication with a suction generating device 161, e.g., a fan.

FIG. 3 further shows a cigarette 4' in the position 14 and a cigarette 4'' in the position 21. The width of the gap between the coaxial cigarettes 4' and 4'' equals the axial length of a plug 24. As mentioned above, such dimensioning of the gap between the cigarettes 4' and 4'' is desirable and advantageous because the cigarettes 4' and 4'' need not be shifted axially toward the filter plug 24 therebetween prior to application of uniting bands to the corresponding groups G.

An important advantage of the improved apparatus is that it treats the rod-shaped constituents of smokers' products gently and also that it enables the machine which embodies such apparatus to produce filter cigarettes or like products whose quality is the same as or comes close to the quality of mass-produced filter cigarettes or the like. Moreover, the apparatus is relatively simple and compact and contributes to compactness of the filter tipping machine. It has been found that a filter tipping machine which embodies the improved apparatus is ideally suited for the production of short series of filter cigarettes which contain selected blends of tobacco, filter material or both.

Figure 4:
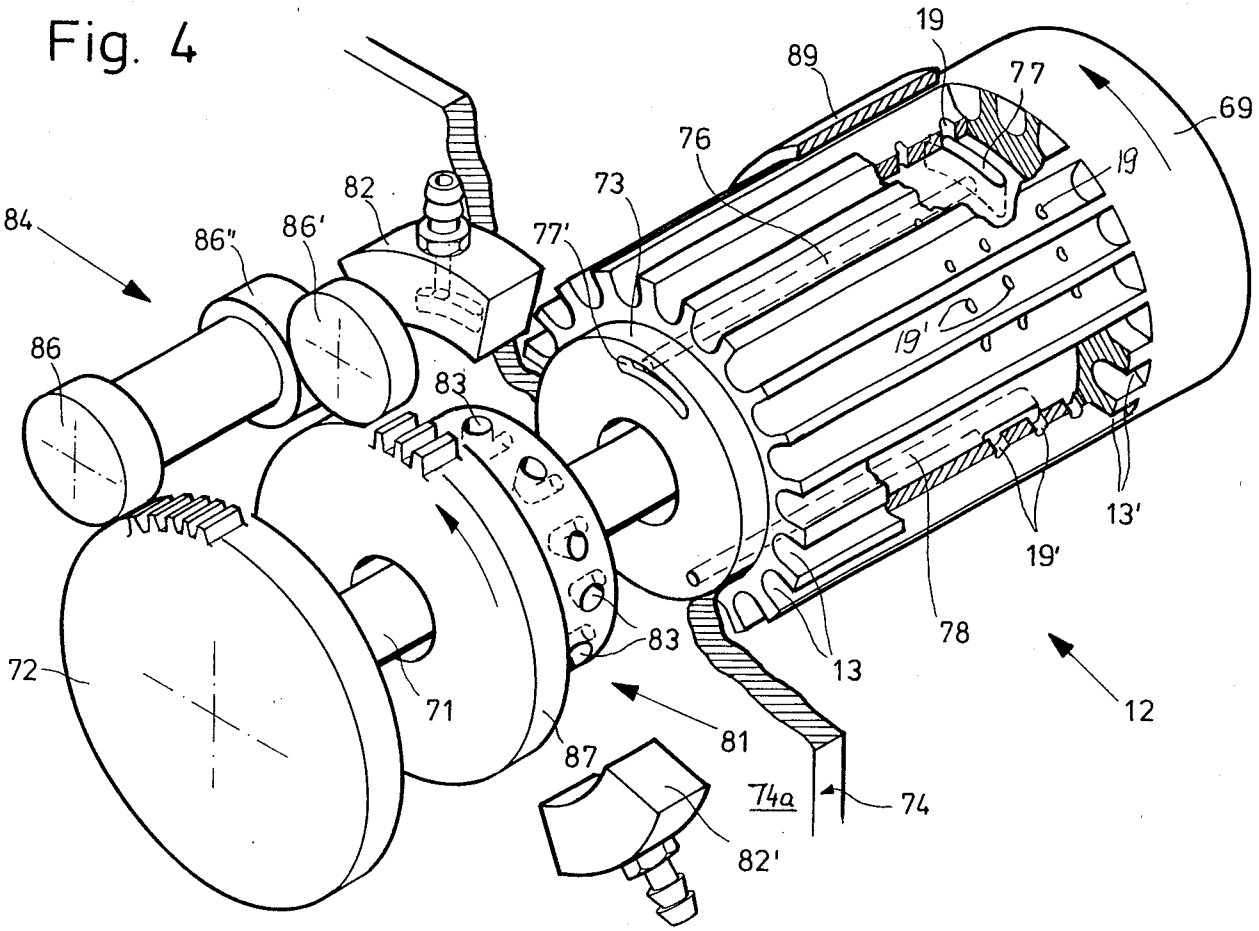
FIG. 4 is an exploded perspective view of a presently preferred embodiment of the first conveyor and of the drive means therefor.

FIG. 4 illustrates in detail a presently preferred construction of the conveyor 12. This conveyor comprises a hollow cylindrical drum-shaped body 69 one end of which is closed by a wall 69' which is integral with the cylindrical portion of 69. Thus, the body 69 resembles an elongated cylindrical cup whose cylindrical component is formed with the aforementioned peripheral flutes 13. The bottom wall 69' is rigid or integral with a drive shaft 71 which is coaxial with the cylindrical component of the body 69 and carries a gear 72 receiving torque from the main prime mover M (FIG. 1) of the filter tipping machine. An intermediate portion of the drive shaft 71 is surrounded by a stationary sleevelike valving element 73 a portion of which extends into the interior of the cylindrical component of the drum body 69.

As explained in connection with FIGS. 1, 2 and 2*a*, the cylindrical component of the drum body 69 is formed with an uneven number $n_1$ = twenty three flutes 13 each of which extends in parallelism with the axis of the drive shaft 71. Each flute 13 extends from the open end of the body 69 toward a discrete stop 13' in the form of a shoulder machined into the external surface of the body 69 close to the end wall 69' and replacing the sealing member 18 of FIGS. 2 and 3. Each flute 13 communicates with a suction port 19 and with two additional suction ports 19'. The suction ports 19 are nearer to the corresponding stops 13' than the respective suction ports 19', and each of the suction ports 19, 19' is a radial bore which extends all the way from the bottom portion of the respective flute 13 to the internal surface of the cylindrical component of the drum body 69. The arrangement is preferably such that the axes of all three suction ports (19, 19' 19') in any selected flute 13 are disposed in a common plane which includes the axis of the drive shaft 71.

For the sake of simplicity, it is assumed that the channel 9 is vertical and is disposed at the twelve o'clock position of the conveyor 12. As explained in connection with FIGS. 1, 2 and 2*a*, the channel 9 discharges a succession of plain cigarettes 4 of unit length into those portions of successive flutes 13 which are adjacent to the open ends of the respective flutes, i.e., into those portions of flutes 13 which are remote from the respective stops 13'. Each flute 13 receives a discrete plain cigarette 4 during each advance past the lower end portion of the channel 9.

The valving element 73 not only serves to regulate the flow of air from the suction ports 19, 19' to the intake of a suction generating device but it also serves as a bearing for the cylindrical component of the drum body 69. As can be readily seen in FIG. 5, the valving element 73 can constitute an integral sleevelike extension of a vertical wall 74, e.g., a portion of the frame 1 of the filter tipping machine. The valving element 73 is formed with an axially parallel bore or passage 76 which is disposed at the twelve o'clock position of the conveyor 12 and extends all the way from the outer side 74*a* of the wall 74 (namely, from that side of this wall which faces away from the valving element 73) and to the suction ports 19 of the flutes 13. That end portion of the bore 76 which is provided in the outer side 74*a* of the wall 74 communicates with an arcuate slot or groove 77' which is machined into the wall 74, and the other end portion of the bore 76 communicates with a similar slot 77 which communicates with the adjacent suction ports 19. As can be seen in FIG. 6, the slots 77 and 77' extend along an arc of approximately 60° from the twelve to the two o'clock position of the conveyor 12. The length of the slots 77 and 77' (as considered in the circumferential direction of the drum body 69) suffices to ensure that the slot 77 communicates with several suction ports 19 in each and every angular position of the body 69. It will be noted that the slots 77 and 77' begin where the channel 9 discharges cigarettes 4 into successive flutes 13 and that such slots extend in the direction of rotation of the drum body 69 under the action of the gear 72 and shaft 71. The centers of curvature of the slots 77 and 77' are located on the axis of the shaft 71.

At the six o'clock position of the conveyor 12, the stationary valving element 73 is formed with a second axially parallel bore or passage 78 which extends from the left-hand side 74a of the wall 74 (as viewed in FIG. 4) to a circumferentially extending slot 79 which is machined into the periphery of the valving element 73 in register with the suction ports 19'. The bore 78 is disposed in the region where the flutes 22 of the second conveyor 17 receive pairs of plain cigarettes 4', 4'' from alternate flutes 13 of the conveyor 12. The width of the slot 79, as considered in the axial direction of the shaft 71, is sufficient to ensure that both suction ports 19' of a given flute 13 communicate with the bore 78.

The conveyor 12 further comprises a rotary valving element 81 which is adjacent to the outer side 74a of the wall 74 and is in sealing and sliding contact with the latter. The cylindrical peripheral surface of the valving element 81 is engaged by the complementary concave surfaces of two stationary shoes 82 and 82', and such peripheral surface is formed with an annulus of $n_2$ suction ports 83 which are equidistant from one another, as considered in the circumferential direction of the valving element 81. The angular distance (angle beta) between the centers of pairs of neighboring suction ports 83 in the peripheral surface of the rotating valving element 81 is indicated in FIG. 6. Each suction port 83 is an L-shaped channel whose discharge end is provided in the peripheral surface of the valving element 81 and whose intake end is provided in that end face of the valving element 81 which is in sliding contact with the wall 74. The number $n_2$ equals $$\frac{n_1+1}{2} \text{ or } \frac{n_1-1}{2}$$

wherein $n_1$ is the odd number of flutes 13 in the peripheral surface of the drum body 69. The passages of the shoes 82, 82' are connected to the intake of a suction generating device, such as the device 161 of FIG. 3.

Figure 5:
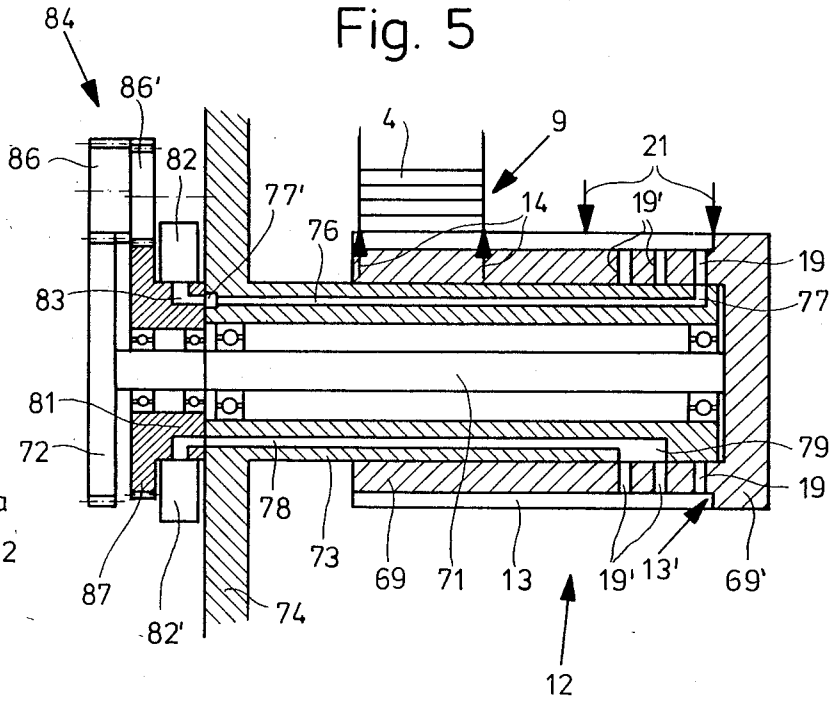
FIG. 5 is an axial sectional view of the conveyor which is shown in FIG. 4.
Figure 6:
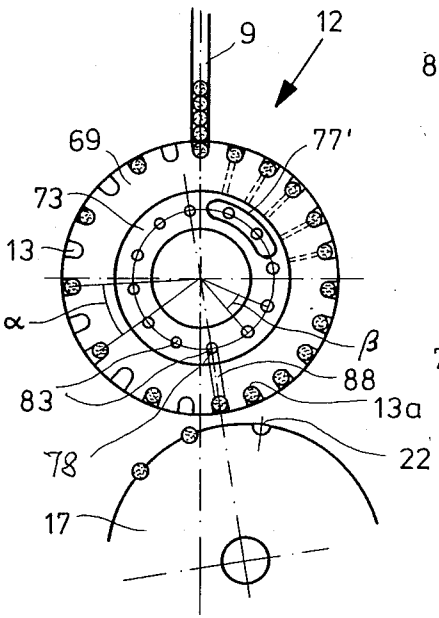
FIG. 6 is a transverse sectional view of the conveyor of FIGS. 4 and 5.

In accordance with a feature of the invention pertaining to the conveyor 12 of FIGS. 4 to 6, the latter further comprises means for rotating the valving element 81 at a speed which deviates from the speed of the drum body 69. To this end, the conveyor 12 comprises a transmission here shown as a gear train 84 including identical gears 86, 86' and 86", the aforementioned gear 72 and a ring gear 87 of the rotary valving element 81. The gear 86 meshes with the gear 72 and is coaxial with the gear 86", the gear 86" meshes with the gear 86', and the latter meshes with the ring gear 87 of the rotary valving element 81.

The parts 73 and 74 can be said to constitute a composite stationary valving element having an end face 74*a* which is in sealing engagement with the adjacent end face of the rotary valving element 81.

The mode of operation of the conveyor 12 which is shown in FIGS. 4, 5 and 6 is as follows:

The drum body 69 has $n_1=23$ equidistant axially parallel peripheral flutes 13. This can be seen in FIG. 6 which further shows the distribution of suction ports 83 in the rotary valving element 81 and the slot 77' which is machined into the outer side 74*a* of the wall 74 and extends from the locus of delivery of plain cigarettes 4 by the channel 9 through an angle of approximately 60° in the direction of rotation of the body 69 when the prime mover M rotates the gear 72. The discharge end of the bore 78 is located at the six o'clock position of the conveyor 12, i.e., at the station where the conveyor 12 delivers pairs of coaxial but spaced-apart plain cigarettes 4' and 4" into successive flutes 22 of the second conveyor 17, and the intake end of the bore 78 is in register with one of the suction ports 83. The angle between the centers of pairs of neighboring flutes 13 equals $360°/n_1$=approximately 15.65°. The rotary valving element 81 is provided with $n_2=12$ suction ports 83, i.e., the number $n_2$ ports 83 approximates half the number of flutes 13

$$\left(n_2=\frac{n_1\pm 1}{2}\right).$$

The angle beta between the axes of two neighboring suction ports 83 equals 30° because the valving element 81 has twelve suction ports 83. The angle alpha denotes in FIG. 6 the angular distance between the centers of alternate flutes 13, and such angle equals 31.3°. In other words, the difference between the angles alpha and beta equals 1.3°. If the drum body 69 and the valving element 81 were to rotate at the same speed, the suction ports 19' of alternate flutes 13 in the rotating drum body 69 would not register at proper time (in the six o'clock position, as viewed in FIG. 6) with the suction ports 83 of the rotary valving element 81 (by way of the bore 78 in the valving element 81), i.e., the conveyor 12 would be incapable of delivering pairs of coaxial cigarettes 4' and 4" into successive flutes 22 of the second conveyor 17. Therefore, the rotational speed of the valving element 81 deviates from the rotational speed of the drum body 69 by a value which is proportional to the difference between the angles alpha (angular distance between the centers of alternate flutes 13) and beta (angular distance between the axes of neighboring suction ports 83). In other words, the gear train 84 carries out a necessary correction to ensure that the difference between the RPM of the drum body 69 and the RPM of the valving element 81 suffices to ensure the transfer of successive pairs of aligned cigarettes 4', 4" from alternate flutes 13 into successive flutes 22. In the embodiment which is shown in FIGS. 4, 5 and 6, the gear 72 has sixtynine gear teeth and the ring gear 87 of the rotating valving element 81 has sixtysix gear teeth. The number of gear teeth on each of the gears 86, 86' and 86" is the same i.e., the transmission ratio of the gear train 84 including the gears 86, 86', 86" is one-to-one.

The peripheral speed of the second conveyor (17) is the same as that of the drum body 69. The number of axially parallel flutes 22 in the periphery of the conveyor 17 equals $n_2=12$. Thus, successive flutes 22 which arrive at the transfer station between the conveyors 12 and 17 register with alternate flutes 13 of the drum body 69.

As already described hereinbefore, the channel 9 supplies plain cigarettes 4 into successive flutes 13 of the rotating drum body 69 in such a way that each cigarette 4 comes to rest in the first position 14. During advancement of successive flutes 13 between the twelve and two o'clock positions of FIG. 6, the cigarettes 4 in the alternate flutes 13 of the drum body 69 are shifted axially from the positions 14 to the positions 21 because the respective suction ports 19 then register with the slot 77 of the stationary valving element 73 and the slot 77 communicates with the suction generating device via bore 76 and slot 77'. The latter communicates with the suction generating device by way of the shoe 82 and a suction port 83 in the rotating valving element 81. The axial shifting of plain cigarettes 4 in alternate flutes 13 from the first positions 14 to the second positions 21 is completed while the respective flutes 13 advance along an arc of approximately 60°, i.e., the length of the slots 77 and 77', as considered in the circumferential direction of the stationary valving element 73. When a cigarette 4 reaches the position 21, it seals the respective suction port 19. A cigarette 4 which remains in the first position 14 (because the second position 21 of the respective flute 13 is already occupied by a cigarette 4") is held only by the shroud 16 as soon as it advances beyond the right-hand ends of the slots 77, 77', as viewed in FIG. 6.

Those flutes 13 of the drum body 69 which do not contain pairs of coaxial cigarettes 4', 4" during travel past the transfer station between the conveyors 12 and 17 (i.e., each flute 13 which merely contains a cigarette (4") in the second position 21) do not register with flutes 22 during travel past the six o'clock position of the conveyor 12, as viewed in FIG. 6. The cigarettes 4" in the second positions 21 which are not aligned with cigarettes 4' are attracted to the surfaces surrounding the respective flutes 13 by suction ports 19' which register with the slot 79 of the stationary valving element 73 at the six o'clock position of the conveyor 12. This is attributable to the difference between the rotational speeds of the drum body 69 and valving element 81. Thus, the shoe 82' connects a suction port 83 of the rotating valving element 81 with the suction generating device and with the bore 78 of the stationary valving element 73 at the six o'clock position of the conveyor 12 when the bore 78 communicates (via slot 79) with the suction ports 19' of that flute 13 which contains only a single cigarette (4'') in the second position 21. The connection between such ports 19' and the bore of the shoe 82' is indicated in FIG. 6 by the reference character 88. The suction ports 19' attract the respective cigarette 4'' for an interval of time which suffices to advance the cigarette 4'' beneath a second arcuate shroud 89 (see FIG. 4) which extends from the six o'clock position to the twelve o'clock position of the conveyor 12 and holds the cigarette 4'' against movement away from the respective flute 13 under the action of gravity and/or centrifugal force. Actually, the second shroud 89 begins slightly downstream of the six o'clock position, as viewed in FIG. 6, because it must enable the cigarettes 4'' in alternate flutes 13 to leave the conveyor 12 and to enter the oncoming successive flutes 22 of the second conveyor 17.

When a flute 13 which contains a cigarette 4'' in the position 21 returns to the twelve o'clock position of the conveyor 12, it receives a fresh cigarette 4 from the channel 9 and such cigarette (4') occupies the first position 14 and remains in such position during advancement of the respective flute 13 beyond the twelve o'clock position because the corresponding suction port 19 is ineffective during movement of such flute along the slots 79 and 79'. This will be readily appreciated because the cigarette 4'' in the second position of such flute 13 seals the intake end of the port 19 and thus prevents the latter from attracting a cigarette from the position 14 to the position 21. Thus, when a flute (**13*a*) which has delivered a cigarette 4'' to the region below the discharge end of the channel 9 advances beyond such channel, it contains two coaxial cigarettes 4', 4'' and advances such cigarettes toward the six o'clock position of the conveyor 12 where it moves into exact register with the oncoming flute 22 of the second conveyor 17. The flutes 13*a* alternate with flutes 13 each of which contains a single cigarette (4'') in the second position 21. Transfer of a cigarette from the first position 14 to the second position 21 is completed not later when the respective flute 13 reaches the ends of the slots 79, 79'. FIG. 6 shows that the flutes 13 which contain only cigarettes 4'' do register with the bore 78 and slot 79 during travel past the six o'clock position in contrast with the flutes 13*a* which do not attract the pairs of cigarettes 4' and 4'' so that such cigarette pairs can be readily transferred into the oncoming flutes 22 of the second conveyor 17 by gravity and/or suction. The ports in the flutes 22 are not specifically shown in the drawing; such ports are connected to a suction generating device while they advance toward, past and beyond the transfer station between the conveyors 12 and 17. The thus emptied flutes 13*a* then advance back toward the discharge end of the channel 9 and each thereof receives a fresh plain cigarette 4 which assumes therein the position 14 but is immediately shifted to the position 21 during travel past the slots 79, 79' of the stationary valving element 73. The same procedure is repeated again and again as long as the prime mover M continues to drive the gear 72 and the latter drives the gear train 84 as well as the drum body 69**.

The difference between the speeds of the drum body 69 and the valving element 81 ensures that, in spite of the difference between the angles alpha and beta, the bore 78 of the stationary valving element 73 invariably communicates with the intake of the suction generating device when the flute 13 which travels past the bore 78 contains a single plain cigarette 4'' in the position 21, i.e., in a position in which such cigarette seals the respective ports 19, 19' and is attracted by the ports 19' to remain in its flute until it reaches the second shroud 89 which, in turn, holds the cigarette 4'' in the flute 13 all the way to the discharge end of the channel 9. This is due to the fact that the shoe 82' connects the bore 78 with the suction generating device by way of a suction port 83 in the rotating valving element 81 when the flute 13 containing a single cigarette 4'' reaches the six o'clock position of the conveyor 12. Inversely, the suction ports 19' in a flute **13*a* which contains a pair of coaxial cigarettes 4' and 4'' do not communicate with the suction generating device by way of the shoe 82' when such flute 13*a* advances past the bore 78 of the stationary valving element 73 so that the suction ports in the oncoming flute 22 of the second conveyor 17 can attract such pair of cigarettes 4', 4'' and the cigarettes are transferred onto the second conveyor 17**.

As mentioned above, the conveyor 12 of FIGS. 4 to 6 has twenty three flutes 13 in the drum body 69 and twelve suction ports 83 in the rotating valving element 81, and the conveyor 17 has twelve flutes 22. The rotational speed of the valving element 81 is less than that of the drum body 69 (by the ratio of the angles alpha and beta). However, if the number of flutes 22 and the number of suction ports 83 is reduced to eleven $$\left(\frac{n_1 - 1}{2}\right),$$

the difference between the angles alpha and beta is changed to 1.43° with a different (negative) sign. The ratio of the transmission including the gears 72, 87, 86, 86', 86'' is then selected in such a way that the speed of the valving element 81 exceeds the speed of the drum body 69. This again ensures that each flute **13*a* which carries two coaxial cigarettes 4', 4'' is relieved of its contents at the six o'clock position of the conveyor 12 because the respective suction ports 19' are then disconnected from the suction generating device and the suction ports in the oncoming flute 22 of the second conveyor 17 can attract such pair of cigarettes at the transfer station between the conveyors 12 and 17**.

The aforediscussed ratio of the number of flutes 13 in the drum body 69 to the number of flutes 22 in the conveyor can be changed practically at will. Basically, the number of flutes in the conveyor 17 is less important than the mutual spacing of such flutes, as considered in the circumferential direction of this conveyor. The number of flutes 22 in the conveyor 17 will depend primarily upon the diameter of the conveyor 17. If the peripheral speed of the conveyor 12 matches that of the conveyor 17 (this establishes the optimum conditions for predictable transfer of pairs of plain cigarettes 4' and 4'' from the flutes 13 into the oncoming flutes 22), the mutual spacing of flutes 22 on the conveyor 17 is the same as the mutual spacing of alternate flutes 13 on the conveyor 12. In other words, the pitch of the flutes 22 is then twice the pitch of the flutes 13. If the apparatus of the present invention employs a large-diameter conveyor 17, the number of flutes 22 in its peripheral surface is increased accordingly, i.e., the number of flutes 22 can be said to be proportional to the diameter of the conveyor 17. As long as the peripheral speed of the conveyor 12 matches that of the conveyor 17, the transfer of pairs of plain cigarettes 4' and 4" from the flutes 13 into the oncoming flutes 22 will be carried out satisfactorily if the mutual spacing of flutes 22 is as described above, namely, twice the mutual spacing of those flutes 13 which carry pairs of cigarettes 4' and 4" toward the transfer station between the conveyors 12 and 17.

Of course, if the peripheral speed of the conveyor 17 deviates from that of the conveyor 12, the mutual spacing of the flutes 22 on the conveyor 17 can be selected practically at will. In other words, if the peripheral speed of the conveyor 17 is not identical with that of the conveyor 12, the mutual spacing of flutes 22 (namely, the distance between the centers of neighboring flutes 22, as considered in the circumferential direction of the conveyor 17) can exceed or can be less than the distance between the centers of successive flutes 13 which carry pairs of cigarettes 4' and 4" toward the transfer station between the conveyors 12 and 17. It will be noted that $n_2$ need not equal $$\frac{n_1 \pm 1}{2}$$

but can be higher or less, depending on the selected diameter of the conveyor 17 and/or on the ratio of peripheral speeds of the conveyors 12 and 17. The aforementioned equation is applicable when the diameters of the conveyors 12 and 17 are identical or nearly identical and if the peripheral speed of the conveyor 12 matches or approximates the peripheral speed of the conveyor 17.

The conveyor 12 of FIGS. 4 to 6 can be used in the filter tipping machine of FIG. 1, i.e., in the apparatus 2. However, it will be readily appreciated that this conveyor can be used with equal advantage in practically all other types of filter tipping machines (e.g., in the MAX and MAX S machines of the assignee of the present application) as well as in all such machines wherein each second receiving means of an endless conveyor is to transfer discrete articles of pairs of articles or more than two articles to a second conveyor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of assembling plain cigarettes or analogous rod-shaped tobacco-containing articles with filter rod sections preparatory to conversion of assembled articles and sections into filter cigarettes or like rod-shaped smoker's products, comprising the steps of delivering a series of articles to an endless conveyor wherein successive articles of the series occupy first positions; advancing the delivered articles with the conveyor at right angles to their respective axes; shifting the articles axially to second positions which are spaced apart from the respective first positions by distance at least matching the length of a filter rod section so that the thus shifted articles provide on the conveyor room for delivery of fresh articles of the series to the first positions previously occupied by the shifted articles and each shifted article is in axial register with a non-shifted article; and introducing filter rod sections between the thus obtained pairs of registering articles.

2. The method of claim 1, wherein said shifting step includes moving the respective articles axially through distances at least approximating the combined length of an article and a filter rod section.

3. The method of claim 1, wherein the articles are plain cigarettes of unit length and the filter rod sections are filter plugs of double unit length.

4. The method of claim 1, wherein said delivering step comprises establishing and maintaining a single supply of parallel articles and feeding the articles from such supply at right angles to the axes of the articles and onto the endless conveyor.

5. The method of claim 1 of assembling rod-shaped articles and filter rod sections on an endless conveyor of the type having a series of parallel receiving means for rod-shaped articles and defining an endless path for the receiving means, wherein said delivering step comprises admitting successive articles into successive receiving means of the series and further comprising the step of holding each shifted article in the respective receiving means longer than necessary for a single transport along the endless path so that each shifted article registers with an article which is subsequently delivered to the same receiving means and occupies the first position therein.

6. The method of claim 5, further comprising the step of transferring successive pairs of registering articles from the respective receiving means onto a second conveyor, said introducing step including inserting filter rod sections into the spaces between airs of registering articles on the second conveyor.

7. The method of claim 6, wherein said inserting step precedes said transferring step.

8. Apparatus for assembling plain cigarettes or anlogous rod-shaped tobacco-containing articles with filter rod sections preparatory to conversion of assembled articles and filter rod sections into filter cigarettes or like rod-shaped smokers' products, comprising a first conveyor having a plurality of parallel receiving means arranged to advance along an endless path; means for delivering discrete articles into successive receiving means so that each of the thus delivered articles assumes a predetermined first position in the respective receiving means; means for shifting articles in the respective receiving means axially from the first positions to predetermined second positions through distances at least matching the combined length of an article and a filter rod section whereby the thus shifted articles provide room for delivery by said delivery means with attendant accumulation of pairs of coaxial articles in the respective receiving means; a second conveyor arranged to receive pairs of coaxial articles from the receiving means of said first conveyor; and means for introducing filter rod sections into the spaces between pairs of articles on one of said conveyors.

9. The apparatus of claim 8, wherein said delivering means comprises means for advancing the articles at right angles to the axes of the respective articles.

10. The apparatus of claim 8, wherein said second conveyor comprises a plurality of parallel receiving means for pairs of articles, the receiving means of said second conveyor being arranged to advance along a second endless path in a direction at right angles to the axes of articles therein.

11. The apparatus of claim 10, wherein the receiving means of said second conveyor are arranged to receive pairs of coaxial articles from alternate receiving means of said first conveyor.

12. The apparatus of claim 10, wherein said introducing means includes a third conveyor arranged to insert filter rod sections into the receiving means of said second conveyor.

13. The apparatus of claim 8, wherein said delivering means comprises a magazine arranged to store a supply of parallel articles and having outlet means defining a channel which discharges at least one layer of parallel articles in a direction at right angles to the axes of such articles.

14. The apparatus of claim 13, wherein said magazine is disposed at a level above said first conveyor and said channel is arranged to deliver to the first conveyor a succession of articles by gravity flow.

15. The apparatus of claim 8, wherein said receiving means are elongated flutes each of which has a length at least matching the combined length of two articles and a filter rod section, each article which assumes said first position being adjacent to one end of the respective flute and each article which assumes said second position being nearer to the other end of the respective flute.

16. The apparatus of claim 8, wherein said first conveyor includes a first rotary drum and said receiving means includes $n_1$ axially parallel flutes provided at the periphery of said drum, said second conveyor comprising a second rotary drum having $$n_2 = \frac{n_1 \pm 1}{2}$$

parallel peripheral flutes for reception of pairs of coaxial articles, $n_1$ being a odd number exceeding one.

17. The apparatus of claim 8, wherein said shifting means includes means for pneumatically moving the articles axially along the respective receiving means.

18. The apparatus of claim 17, wherein each of said receiving means includes an elongated flute having an open side and said moving means comprises a shroud outwardly adjacent to a predetermined portion of said path and arranged to at least substantially seal the open sides of the flutes from the atmosphere, means for at least substantially sealing one end of each flute in said portion of said path, and at least one suction port provided in each of said flutes in the region of said one end of the respective flute.

19. The apparatus of claim 18, wherein said portion of said path is disposed immediately downstream of said delivering means, as considered in the direction of advancement of flutes along said path.

20. The apparatus of claim 8, wherein each article is a plain cigarette of unit length and each filter rod section is a filter plug of double unit length.

21. The apparatus of claim 8, wherein said first conveyor comprises a first rotary drum and said receiving means comprises axially parallel peripheral flutes provided at the periphery of said drum and being at least substantially equidistant from one another, as considered in the circumferential direction of said drum, said second conveyor comprising a second rotary drum having axially parallel peripheral flutes for reception of pairs of coaxial articles, the mutual spacing of neighboring flutes of said first drum being equal to half the mutual spacing of neighboring flutes on said second drum.

* * * * *